US012759780B2

(12) United States Patent
Rhea et al.

(10) Patent No.: US 12,759,780 B2
(45) Date of Patent: Oct. 13, 2026

(54) FOOD STORAGE ASSEMBLY AND INSERT FOR LAYERED FOOD ITEMS

(71) Applicant: D&W Fine Pack, Wood Dale, IL (US)

(72) Inventors: Scott Rhea, Albion, IN (US); Ryan Krauskopf, Fort Wayne, IN (US)

(73) Assignee: D&W Fine Pack, Wood Dale, IL (US)

( * ) Notice: Subject to any disclaimer, the term of this patent is extended or adjusted under 35 U.S.C. 154(b) by 290 days.

(21) Appl. No.: 18/456,564

(22) Filed: Aug. 28, 2023

(65) Prior Publication Data

US 2024/0067430 A1 Feb. 29, 2024

Related U.S. Application Data

(60) Provisional application No. 63/444,250, filed on Feb. 9, 2023, provisional application No. 63/402,322, filed on Aug. 30, 2022.

(51) Int. Cl.

| | |
|---|---|
| ***B65D 75/58*** | (2006.01) |
| ***B65D 25/02*** | (2006.01) |
| ***B65D 65/06*** | (2006.01) |

(52) U.S. Cl.

CPC ..... *B65D 75/5844* (2013.01); *B65D 25/02* (2013.01); *B65D 65/06* (2013.01); *B65D 2575/58* (2013.01)

(58) Field of Classification Search

CPC .... B65D 65/06; B65D 25/02; B65D 2575/58; B65D 75/5844; B65D 81/3453; B65D 2581/3494

USPC ..... 206/467

See application file for complete search history.

(56) References Cited

U.S. PATENT DOCUMENTS 5,266,763 A * 11/1993 Colombo ..... B65D 25/18 219/734

FOREIGN PATENT DOCUMENTS

KR 20110005199 U * 5/2011 ..... B65D 17/401

* cited by examiner

*Primary Examiner* — Anthony D Stashick
*Assistant Examiner* — L Kmet
(74) *Attorney, Agent, or Firm* — Dority & Manning, P.A.

(57) ABSTRACT

A food storage assembly is provided. The food storage assembly includes a container including a base and an opening defining a rim, wherein a side wall is circumferentially disposed between the base and the rim. The food storage assembly further includes an insert having a base, wherein the insert includes two or more side portions connected to the base and extending radially therefrom, wherein the two or more side portions are flexible and are folded to form a side wall conforming to a shape of the side wall of the container when the insert is positioned inside the container.

20 Claims, 7 Drawing Sheets

FOOD STORAGE ASSEMBLY AND INSERT FOR LAYERED FOOD ITEMS

RELATED APPLICATIONS

This application claims priority to U.S. Provisional Application Ser. No. 63/444,250, filed on Feb. 9, 2023, and U.S. Provisional Application Ser. No. 63/402,322, filed on Aug. 30, 2022, which are each incorporated by reference herein in their entirety.

FIELD OF THE INVENTION

The present disclosure is directed to a food storage assembly including a container and insert for layered food items. In particular, the food storage assembly can include a peel-away insert or liner for layered gelato, cakes, or a combination thereof. A stand-alone peel-away liner or insert for a food storage assembly is also contemplated.

BACKGROUND OF THE INVENTION

Specific containers are frequently used to store and contain food items. Such containers may also be used when preparing food items at one location and then transporting the food items to another location for use. Such containers may also be used as a means to further process the food item, such as by freezing and using the food item later.

However, when the food item is to be served or consumed, difficulties may occur. For example, removing food items from containers may cause streaking on the sides of the food item in contact with the container when the food item is removed. In addition, the sides of the food item may also be damaged when the food item is removed from the container due to the food item being tightly fit within the container.

In light of the above, a need exists for a container that prevents streaking of the sides of the food item stored in the container. A need also exists for the layered food item to be easily removable from the container without damaging the sides of the food item, especially when the food item is tightly fitted within the container.

SUMMARY OF THE INVENTION

In accordance with one aspect of the present disclosure, a food storage assembly is provided. The food storage assembly includes a container including a base and an opening defining a rim, wherein a side wall is circumferentially disposed between the base and the rim. The food storage assembly further includes an insert having a base, wherein the insert includes two or more side portions connected to the base and extending radially therefrom, wherein the two or more side portions are flexible and are folded to form a side wall conforming to a shape of the side wall of the container when the insert is positioned inside the container.

In one aspect, the food storage assembly includes a thermoformed or an injection molded plastic.

In another aspect, the container and the insert include a transparent or translucent material.

In yet another aspect, the two or more side portions of the insert include an upper edge and a lower edge. Further, in the same aspect, at least one of the two or more side portions of the insert further includes a tab adjacent the upper edge of the at least one of the two or more side portions.

In still another aspect, the food storage assembly further includes a lid attachable to the rim of the container. Further, in the same aspect, the lid includes an upper surface and a lower surface and the lower surface of the lid includes a protrusion, the protrusion shaped to receive the tab.

In a still further aspect, the side portions forming the side wall of the insert are separable from each other.

In yet a further aspect, the insert includes a flexible material.

In another further aspect, the insert has a thickness ranging from about 0.001 inches to about 0.1 inches.

In further another aspect, the insert further includes a perforated section, an indentation, a groove, or a combination thereof located along a connection point between the base of the insert and at least one of the two or more side portions of the insert.

In another embodiment, the present disclosure is directed to an insert of a food storage assembly where the insert includes a food-safe, foldable material. The insert includes a base. The insert further includes two or more side portions connected to the base and extending radially therefrom, wherein the two or more side portions are flexible and form a side wall when folded.

In still another embodiment, the present disclosure is directed to a method of assembling a layered food item. The method includes providing a food storage assembly including a container including a base and an opening defining a rim, wherein a side wall is circumferentially disposed between the base and the rim, and an insert having a base, wherein the insert includes two or more side portions connected to the base and extending radially therefrom, wherein the two or more side portions are flexible and form a side wall conforming to a shape of the side wall of the container when the insert is positioned inside the container. The method further includes positioning the insert into the container. The method also further includes arranging a layer of a first food item within the insert. The method still further includes arranging a layer of a second food item atop the layer of the first food item within the insert.

In one aspect, the layer of the first or second food item is placed via an automated process.

In another aspect, the first food item is a solid food item. Further, in the same aspect, the second food item is a freezable, liquid food item.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE FIGURES

A full and enabling disclosure of the present disclosure to one skilled in the art, including the best mode thereof, is set forth more particularly in the remainder of the specification, including reference to the accompanying figures, in which.

Figure 1:
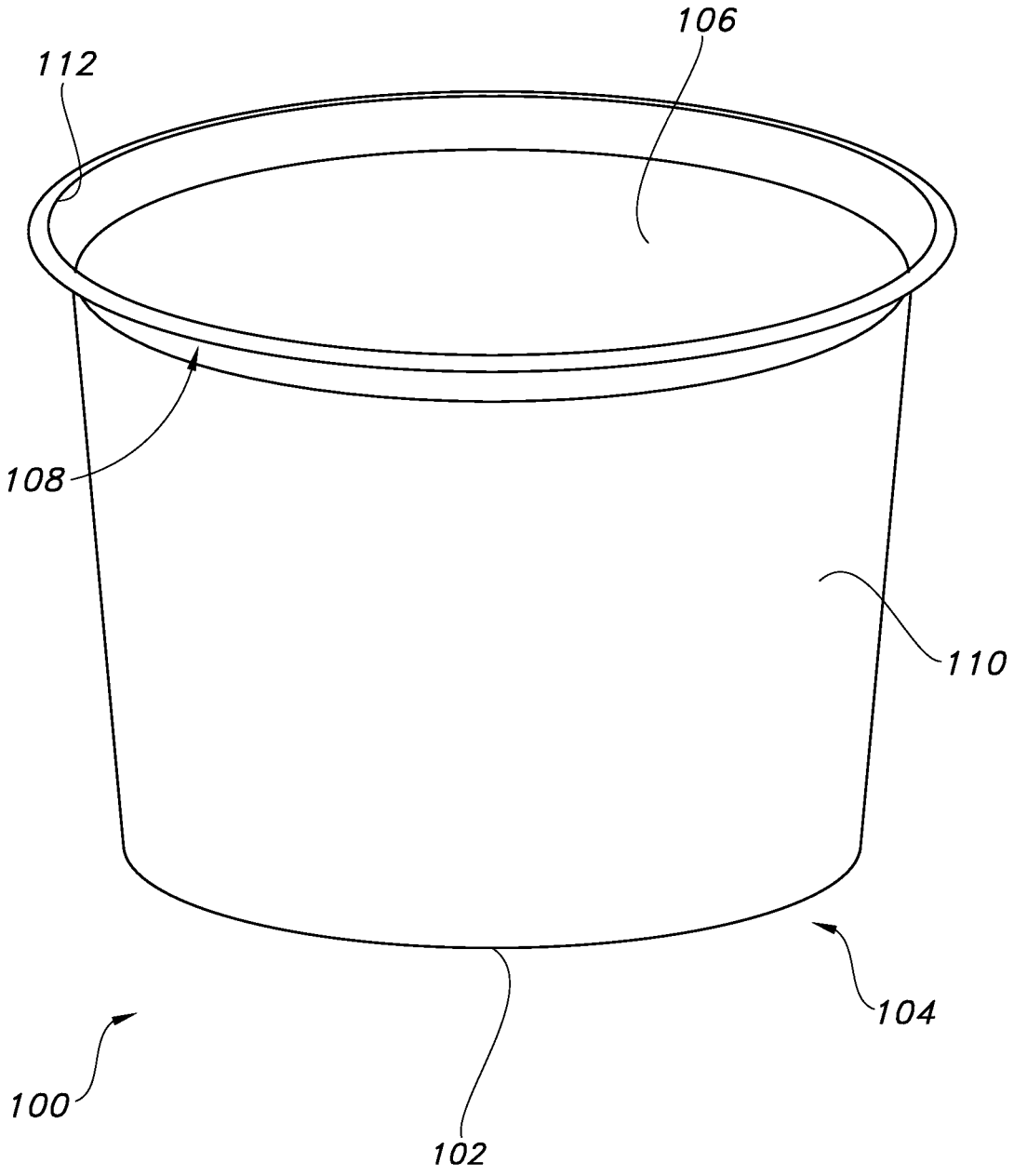
FIG. 1 illustrates a perspective view of an embodiment of a container of a food storage assembly according to the present disclosure.

Repeat use of reference characters in the present specification and drawings is intended to represent the same or analogous features or elements of the present disclosure.

DETAILED DESCRIPTION

Reference now will be made in detail to various embodiments of the disclosure, one or more examples of which are set forth below. Each example is provided by way of explanation of the disclosure, not limitation of the disclosure. In fact, it will be apparent to those skilled in the art that various modifications and variations may be made in the present disclosure without departing from the scope or spirit of the disclosure. For instance, features illustrated or described as part of one embodiment, may be used on another embodiment to yield a still further embodiment. Thus, it is intended that the present disclosure covers such modifications and variations as come within the scope of the appended claims and their equivalents.

Generally speaking, the present disclosure is directed to a food storage assembly including an insert and the insert alone. The food storage assembly includes a container with a base, an opening defining a rim, and a side wall that is circumferentially disposed between the base and the rim. The food storage assembly further includes an insert having a base and two or more side portions connected to the base and extending radially therefrom. The two or more side portions of the insert are flexible and form a side wall conforming to the side wall of the container when the insert is positioned inside the container. The combination of features provides a food storage assembly that allows for an easier assembly, transport, and serving of layered food items. However, it should also be understood that the insert alone is also contemplated by the present disclosure.

In addition, the food storage assembly may be used to assemble a layered food item. The method of assembling said layered food item may include providing the food storage assembly. The method can include positioning the insert of the food storage assembly into the container of the food storage assembly. The method can also include arranging a layer of a first food item within the insert and arranging a layer of a second food item atop the layer of the first food item within the insert. By using the food storage assembly in such a method, the combination of features enables an easier transport and removal of such layered food items without damaging the integrity or appearance of said layered food items. For example, when the layered food item is to be served, the side wall of the insert can be easily removed from the layered food item without causing any streaking or other defects to the appearance of the layered food item.

Referring now to the figures, FIG. 1 illustrates an embodiment of a container of a food storage assembly according to the present disclosure. As shown, the container 100 includes a base 102 defining a perimeter 104, an opening 106 defining a rim 108, and a side wall 110. As shown, the side wall 110 of the container 100 is circumferentially disposed between the base 102 and the rim 108.

In addition, the container 100 may be formed of a transparent or translucent material. By forming the container 100 from such a material, the interior contents of the container 100 may be more easily seen such that assembly and removal of a layered food item is more easily monitorable as will be discussed hereinbelow.

Figure 2A:
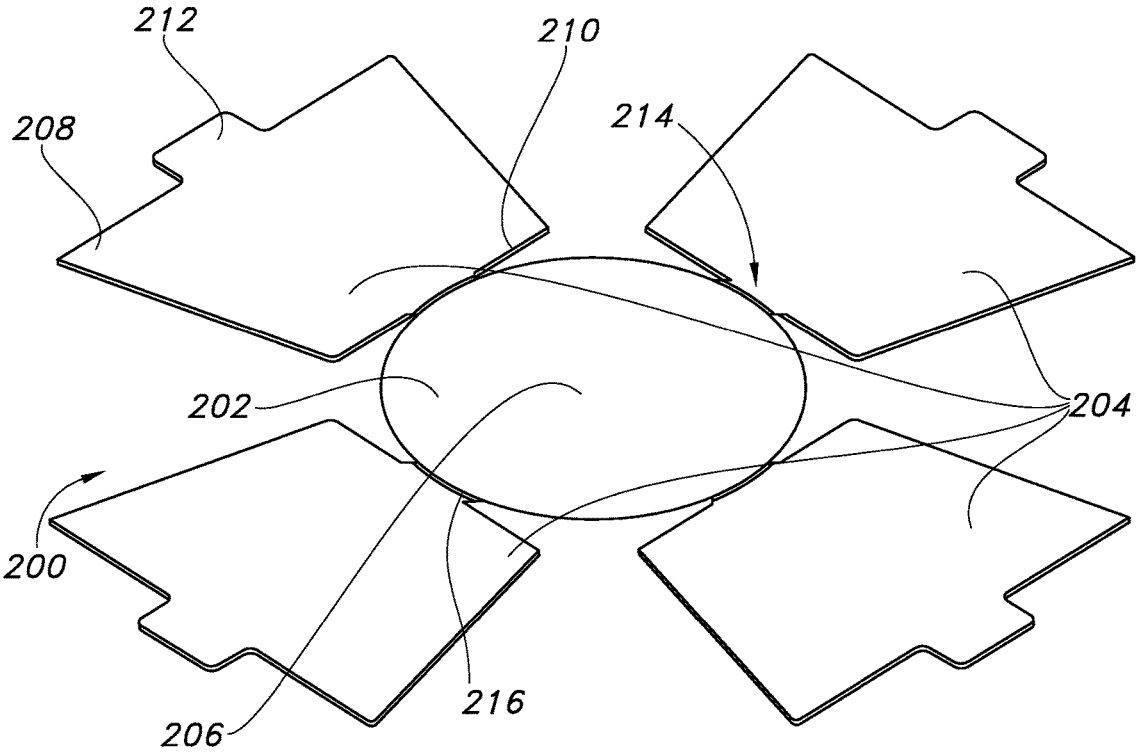
FIGS. 2A-2C illustrate an embodiment of an insert of a food storage assembly, particularly illustrating the insert in an unfolded state, a completely folded state, and a peeled state according to the present disclosure.
Figure 2B:
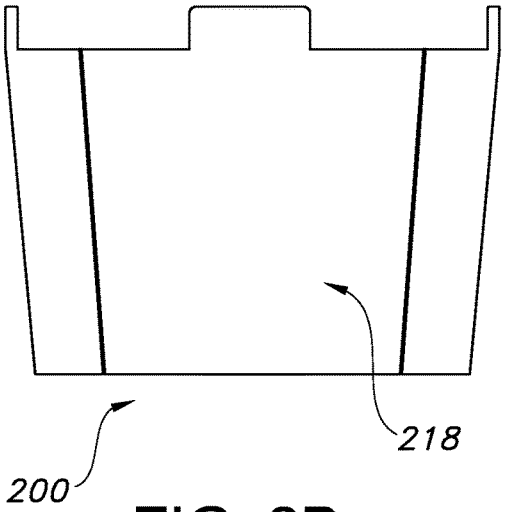
Figure 2C:
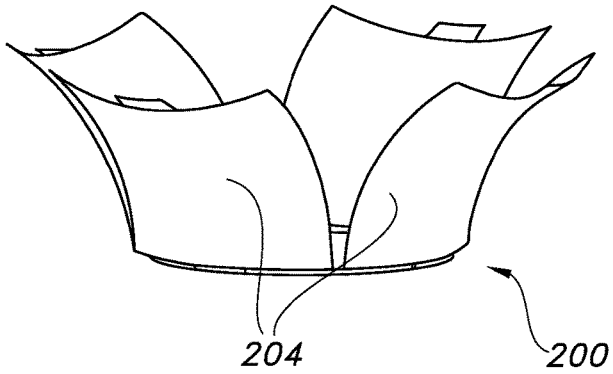

Referring now to FIGS. 2A-2C, an embodiment of an insert 200 to be used within a food storage assembly is illustrated according to the present disclosure. In particular, FIGS. 2A-2C illustrate various orientations of the insert 200 corresponding to stages of use. In particular, FIG. 2A illustrates an insert 200 in an unfolded state, FIG. 2B illustrates an insert 200 in a completely folded state, and FIG. 2C illustrates an insert 200 in a partially folded state.

Referring now to FIG. 2A, the insert 200 includes a base 202 and side portions 204. In a preferred embodiment, the base 202 of the insert 200 has a shape that is similar to the base 102 of the container 100. For example, if the base 102 of the container 100 is a circle with a center (not shown), then it may be advantageous to provide an insert 200 with a base 202 that is also a circle with a center 206. In particular, by providing similar shapes for the bases 102, 202 the side portions 204 of the insert 200 may more easily form a continuous side wall 218 (see FIG. 2B) when inserted into the container 100. Further, the side portions 204 of the insert 200 may be formed from a flexible material and form the side wall 218.

Figure 3A:
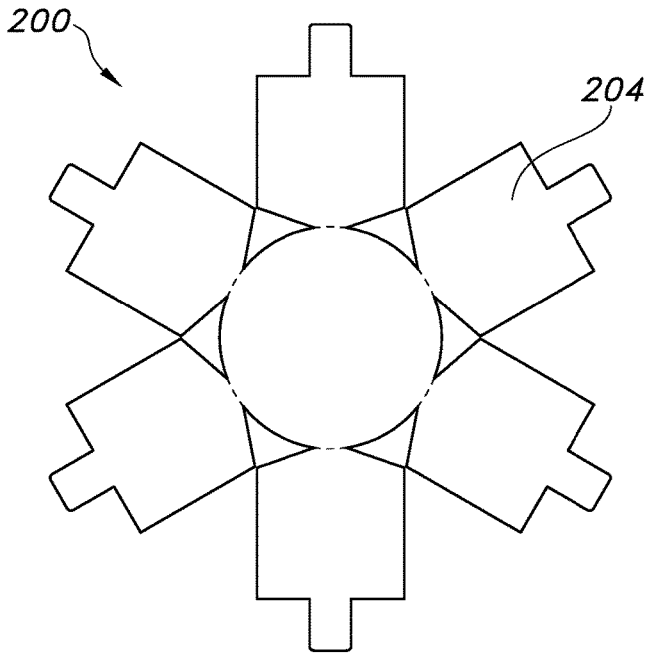
FIGS. 3A-3B illustrate various other embodiments of inserts for a food storages assembly according to the present disclosure.
Figure 3B:
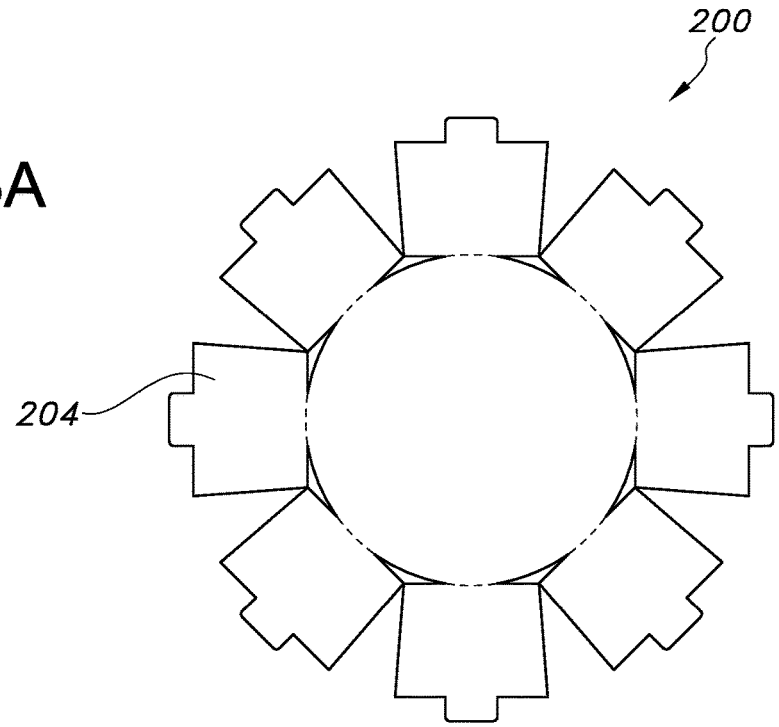

Four side portions 204 of the insert 200 are shown, but any number of side portions 204 may be provided that is suitable. Specifically, the insert 200 can include two side portions 204, three side portions 204, four side portions 204, or more as needed. For example, referring to FIGS. 3A-3B, the insert 200 is shown as including six side portions 204 and eight side portions 204 respectively. However, although four, six, and eight side portions 204 are depicted, it should be understood that any number of side portions 204 may be provided with the insert 200.

In addition, the side portions 204 of the insert 200 may include an upper edge and a lower edge 210. Adjacent the upper edge 208 of the side portions 204, a tab 212 may be present. As shown, the tab 212 may be formed on each of the side portions 204 of the insert 200. However, it should be understood that the tab 212 may be located on any number of the side portions 204 of the insert 200. For example, the tab 212 may be located on one side portion 204, two side portions 204, three side portions 204, or on all the side portions 204. By forming the tab 212 along the side portions 204, the insert 200 may be more easily lifted when the side wall 218 is formed.

Like the container 100, the insert 200 may be formed of a transparent or translucent material. By forming the insert 200 from such a material, the interior contents of the insert 200 may be more easily seen such that assembly and removal of a layered food item is more easily monitorable. Further, when both the container and the insert 200 are formed of a transparent or translucent material, this benefit may be further emphasized. For example, when the insert 200 is placed within the container 100, the assembly of a layered food item within the insert 200 and the container 100 can be more easily monitored.

Still referring to FIG. 2A, the insert 200 may also include one or more perforated section(s) 216. As shown, the one or more perforated section(s) 216 is/are formed along connection points 214 between the base 202 and side portions 204.

The one or more perforated section(s) 216 allow(s) for folding of the side portions 204 to form the side wall 218 of the insert 200 as shown in FIG. 2B. The one or more perforated section(s) 216 may include one or more of a variety of features. For example, the perforated section may include perforations, indentations, or grooves. Further, the insert 200 may have a specific thickness. For example, the thickness of the insert 200 may range from about 0.001 inches to about 0.1 inches, such as about 0.002 inches to about 0.05 inches, such as about 0.003 inches to about 0.025 inches.

Referring to FIGS. 2B, the insert 200 is shown with the side wall 218 formed from the plurality of side portions 204. When the side portions 204 are folded upward, along the one or more perforated section(s) 216, the side portions 204 may form the side wall 218. For example, when the insert 200 is inserted into the container 100, the side portions 204, which extend past the perimeter 112 of the rim of the container 100, may be folded upwards as the insert 200 is further inserted into the container 100. In particular, the side portions 204 may continue to be folded upwards until the side wall 218 is formed. The formation of the side wall may be achieved before the center 206 of the insert meets with the base 102 of the container 100 or at the moment the center 206 of the insert meets with the base of the container 100.

The side wall 218 may also be formed prior to or without placing the insert within the container. For example, a user or apparatus may fold the side portions 204 of the insert 200 upwards to form the side wall 218. The side portions may then remain in place once folded upwards to form the side wall 218. This feature may be achieved as a consequence of the design of the insert 200. For example, if a perforated section 216 is placed along the insert 200, the insert 200 may undergo plastic deformation that prevents the side portions 204 from elastically returning to an unfolded state like as shown in FIG. 2A.

Further, referring now to FIG. 2C, the side portions 204 which form the side wall 218 of the insert 200 can be separable from each other. For example, when the insert 200 is removed from the container 100, the side wall 218 may be peeled back thereby revealing the plurality of side portions 204 of the insert 200. This feature may be achieved as a consequence of forming the side wall 218 from the plurality of side portions 204.

Figure 4:
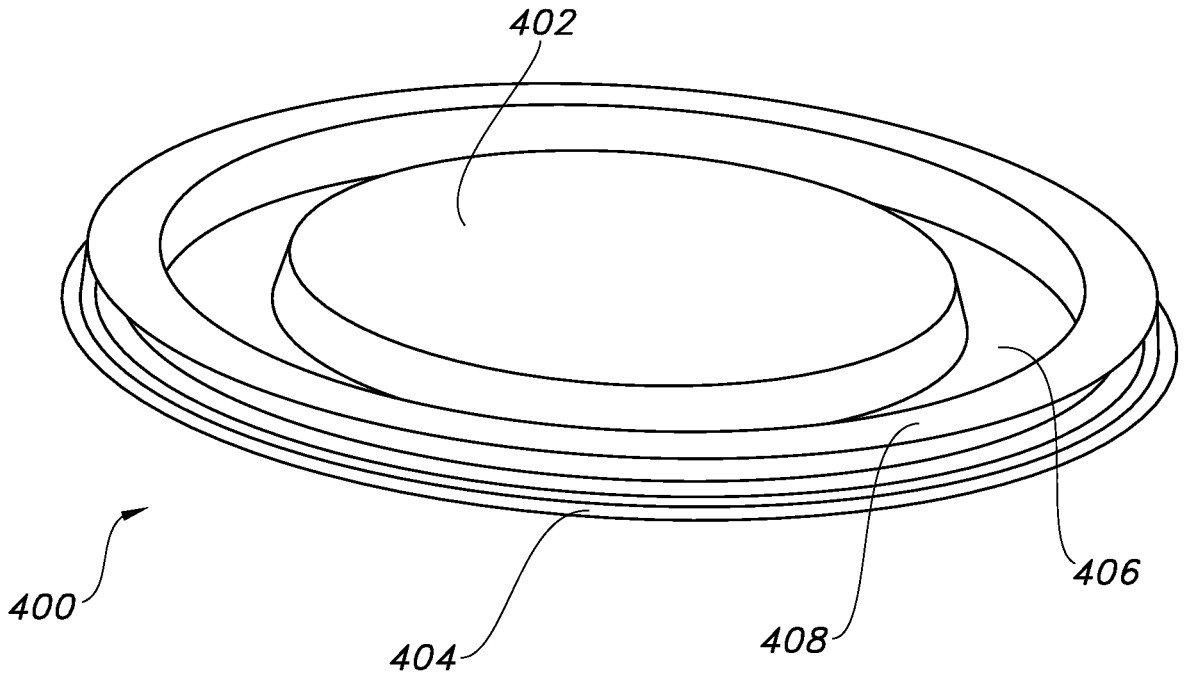
FIG. 4 illustrates an embodiment of a lid of a food storage assembly according to the present disclosure.

Referring now to FIG. 4, an embodiment of a lid of a food storage assembly is illustrated. As shown, the lid 400 includes an upper surface 402 and a lower surface 404. The lid 400 may also include an indentation 406 and a protrusion 408. By providing a protrusion 408, the lid 400 may more easily fit atop the container 100 and the insert 200. Further, the protrusion 408 may be shaped to receive the insert 200. For example, if the insert 200 includes tab(s) 212, protrusion 408 may be shaped to receive the tab(s) 212. In particular, the protrusion 408 may be a similar height or a greater height then the tab(s) 212 such that the tab(s) 212 can fit within the protrusion 408 when the lid 400 is placed on the container 100.

Figure 5:
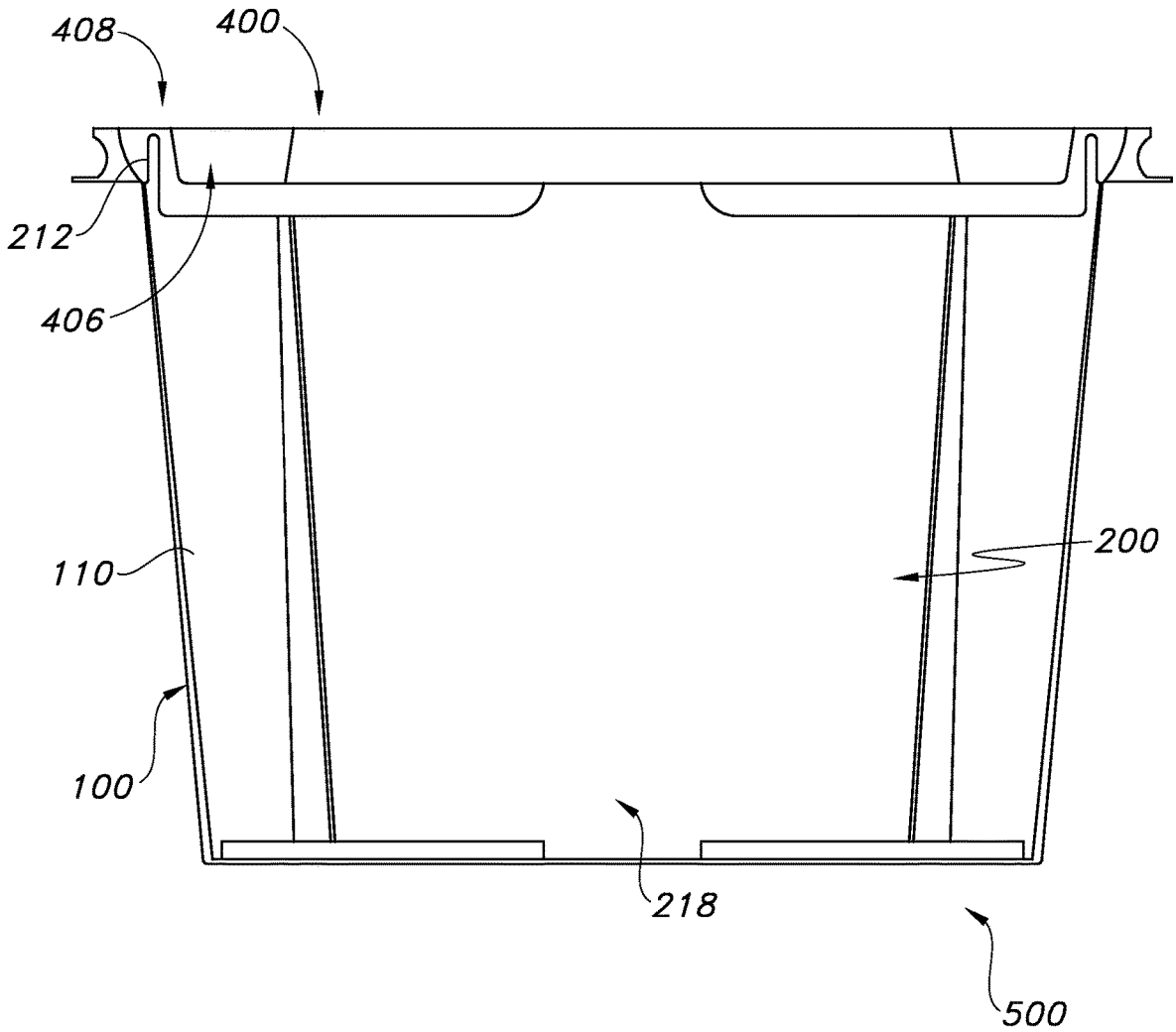
FIG. 5 illustrates an embodiment of a food storage assembly, particularly illustrating the insert inside the container and the lid placed on top of the container according to the present disclosure.

Referring now to FIG. 5, an embodiment of a food storage assembly is illustrated. In particular, the food storage assembly 500 includes the container 100, the insert 200 placed within the container, and the lid placed atop the container. As shown, the side wall 218 of the insert 200 conforms to the side wall 110 of the container. This may be achieved as discussed above with reference to FIG. 2B. In addition, forming the side wall 218 from the plurality of side portions 204 may be further assisted by forming the insert 200 from a flexible material or by providing one or more perforated section(s) 216 along the insert 200. Further, as shown, if tab(s) are formed on the insert 200, the tab(s) 212 may be received within a protrusion of the lid 400.

To enhance the speed of production of the food storage assembly 500, each component of the food storage assembly 500 may be formed from a thermoformed plastic or an injection molded plastic. However, it should be understood that individual components of the food storage assembly 500 may be formed from a thermoformed plastic or an injection molded plastic, while forming other components from different materials. For example, the container 100 and insert 200 may be formed from a thermoformed or injection molded plastic, while the lid 400 is formed from a different material.

Figure 6A:
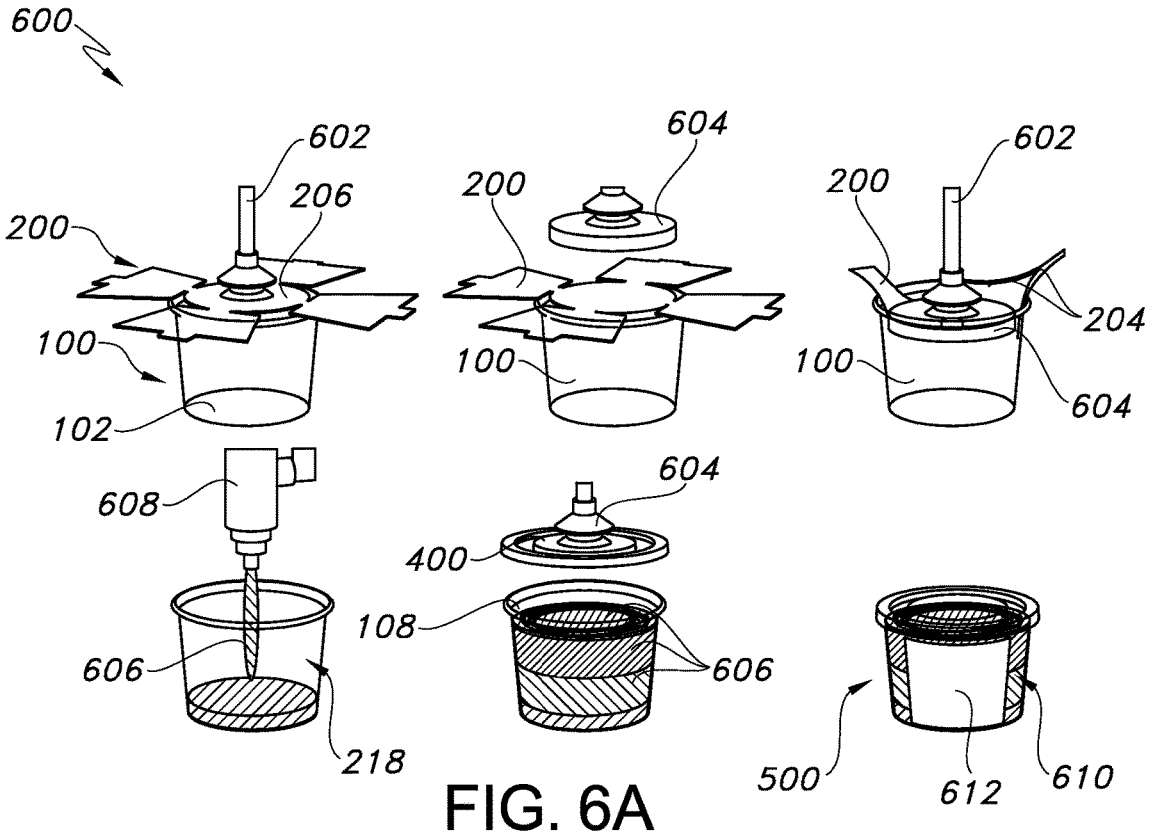
FIGS. 6A-6B illustrate a method of forming a layered food item within a food storage assembly and removing the layered food item from the food storage assembly according to one embodiment of the present disclosure.
Figure 6B:
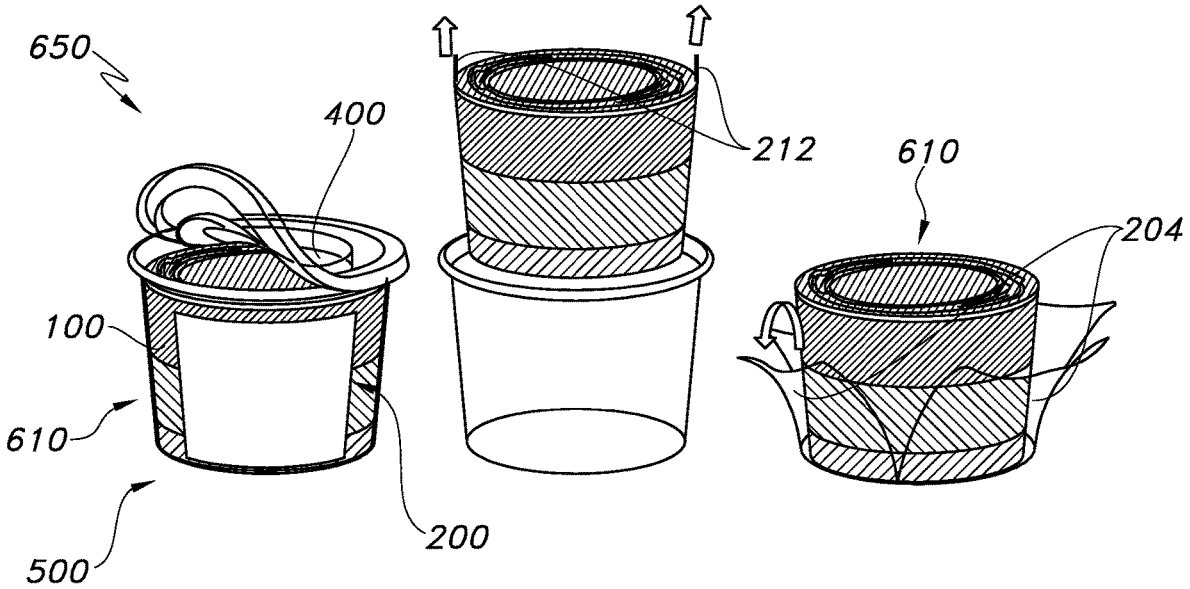

Referring now to FIGS. 6A-6B, an embodiment of a system for forming a layered food item within the food storage assembly and removing the layered food item from the food storage assembly is illustrated. As shown in FIG. 6A, the system of assembling a layered food item 610 includes an arm 602, a first food item 604, at least one second food item 606, and a dispenser 608. In particular, the arm may be capable of placing a variety of items into the container 100. For example, the arm 602 may position the insert 200 atop the container 100. More specifically, the arm 602 may align the center 206 of the insert 200 with the base of the container 100 in a vertical direction. The arm 602 may also place the first food item 604 atop the insert 200 and press the first food item 604 and the insert into the container 100, thereby forming the side wall 218 of the insert 200 via the folding of the side portions 204 upwards as discussed in reference to FIG. 2B. The first food item 604 may be a solid food item such as a cake or other form of confections. The arm 602 may also directly place the insert 200 within the container thereby forming the side wall 218, and place the first food item 604 within the container 100 and the insert 200. However, by placing the insert 200 and first food item 604 within the container 100 simultaneously, damage to the first food item 604 may be prevented. In particular, if the side wall 218 of the insert 200 is formed before the first food item 604 is placed, the first food item 604 may be contacted with the side wall 218 of the insert 200 as the first food item 604 is placed within the insert 200. Further, the arm 602 may attach the lid 400 to the rim 108 of the container 100.

The dispenser 608 may be capable of dispensing at least one second food item 606 to form the layered food item 610. For example, the dispenser 608 may dispense only one second food item 606. The dispenser 608 may also dispense two, three, or more second food items 606 atop the first food item 604. Multiple dispensers 608 may also be provided to dispense additional layers of second food items 606 or different types of food items 606. The second food item 606 may be a freezable, liquid food item such as a custard, an ice cream, a sherbet, or type of frozen dessert. A label 612 may also be applied to the container 100 or any other part of the food storage assembly 500 during the process of inserting the layered food item 610 within the food storage assembly 500. Moreover, the first food item and the second food item 606 may be interchangeable. For example, the second food item 606 may be placed first and then first food item 604 may be placed second. Further, the first food item 604 may be a freezable, liquid food item, and the second food item may be a solid food item as discussed hereinabove.

Although a first and second food item 604, 606 are described, it should be understood that an individual food item may also be dispensed within the container 100. For example, the first food item 604 may be placed in the container 100 without the second food item 606 or vice versa.

Referring now to FIG. 6B, a system 650 of removing the layered food item from the food storage assembly 500 is illustrated. As shown, the lid 400 is removed from the container 100. Further, as shown, the insert 200 is removed from the container 100. The insert 200, containing the layered food item 610, is removed from the container 100 by the tab(s) 212 formed on the insert 200. The tab(s) 212 assist in removing the insert 200 from the container 100 without touching or otherwise tampering with the layered food item 610, but the tab(s) 212 may not be necessary to remove the insert 200. For example, the insert 200 may be removed by lifting from the side wall 218 of the insert 200. Once removed from the container 100, the side portions 204 which form the side wall 218 of the insert 200 may be separated into individual side portions 204 thereby revealing the layered food item 610. It should be understood that by providing side portions 204 that are separable in such a manner, the layered food item 610 may be removed from the insert 200 without damaging the appearance or quality of the distinct layers of the first and second food items 604, 606 of the layered food item 610.

Figure 7:
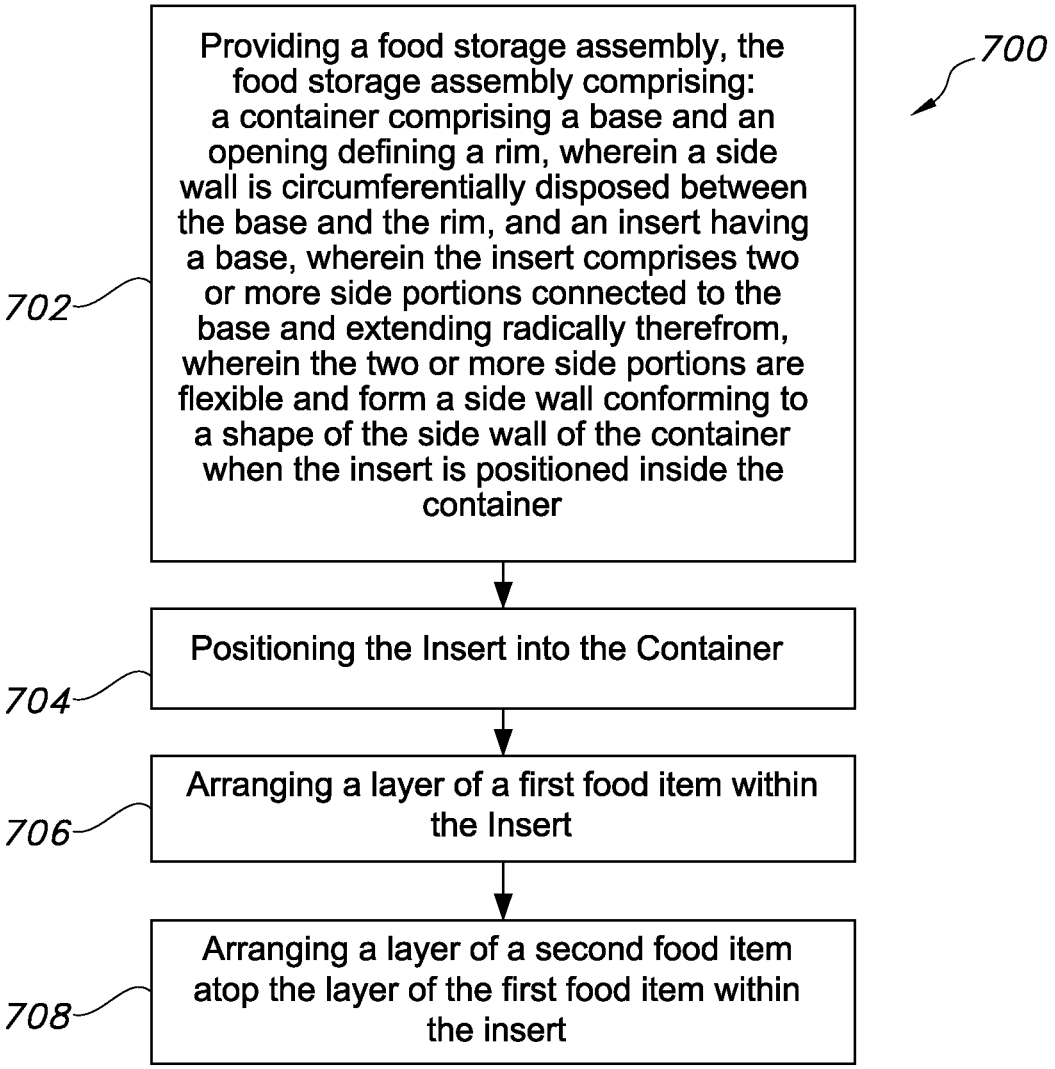
FIG. 7 illustrates a flow diagram of a method of forming a layered food item within the food assembly according to one embodiment of the present disclosure.

Turning now to FIG. 7, a flow diagram depicting a method of placing or inserting a layered food item within the food assembly according to the present disclosure is illustrated. As shown, the method 700 includes the step 702 of providing a food storage assembly, such as the food storage assembly 500. Step includes positioning the insert of the food storage assembly into the container of the food storage assembly. Step 706 involves arranging a layer of a first food item within the insert. Step 708 involves arranging a layer of a second food item atop the layer of the first food item within the insert. Either the layer of the first or second food item may be placed via an automated process such as a process using the system 600 discussed in reference to FIG. 6A. Further, as discussed above, the first food item may be a solid food item, such as a cake, and the second food item may be a freezable, liquid food item, such as a custard, ice cream, or a sherbet.

The present disclosure has been described both in general and in detail by way of examples. These and other modifications and variations of the present disclosure may be practiced by those of ordinary skill in the art, without departing from the spirit and scope of the present disclosure. In addition, it should be understood that aspects of the various embodiments may be interchanged both in whole or in part. Furthermore, those of ordinary skill in the art will appreciate that the foregoing description is by way of example only, and is not intended to limit the disclosure so further described in such appended claims.

What is claimed is:

1. A food storage assembly comprising:

a container comprising a base and an opening defining a rim, wherein a side wall is circumferentially disposed between the base and the rim, the side wall of the container defining a curvilinear shape; and an insert having a base, wherein the insert comprises two or more side portions connected to the base and extending radially therefrom, wherein the two or more side portions are flat in an initial unfolded configuration of the insert, wherein the two or more side portions are flexible and are configured to fold to form a side wall conforming to the curvilinear shape of the side wall of the container when the insert is positioned inside the container.

2. The food storage assembly of claim 1, wherein the food storage assembly comprises a thermoformed or injection molded plastic.

3. The food storage assembly of claim 1, wherein the container and the insert comprise a transparent or translucent material.

4. The food storage assembly of claim 1, wherein the two or more side portions of the insert comprise an upper edge and a lower edge, wherein at least one of the two or more side portions of the insert further comprises a tab adjacent the upper edge of the at least one of the two or more side portions, wherein the base of the insert defines a curvilinear outer perimeter, wherein the lower edge of each side portion defines a straight line in the initial unfolded configuration of the insert, and wherein each side portion is attached to the curvilinear outer perimeter of the base of the insert at the lower edge of the respective side portion.

5. The food storage assembly of claim 4, further comprising a lid attachable to the rim of the container, wherein the lid comprises an upper surface and a lower surface, wherein the lid comprises a protrusion extending upward from the lower surface of the lid, the protrusion shaped to receive the tab vertically below the protrusion with the tab positioned radially outward of an indentation in the lid.

6. The food storage assembly of claim 1, wherein the side portions forming the side wall of the insert are separable from each other.

7. The food storage assembly of claim 1, wherein the insert comprises a flexible material.

8. The food storage assembly of claim 1, wherein the insert has a thickness ranging from 0.001 inches to 0.05 inches.

9. The food storage assembly of claim 1, wherein the insert further comprises a perforated section, an indentation, a groove, or a combination thereof located along a connection point between the base of the insert and at least one of the two or more side portions of the insert.

10. An insert of a food storage assembly, wherein the insert comprises a food-safe, foldable material, the insert comprising:

a base, the base comprising a curvilinear outer perimeter; and two or more side portions connected to the base and extending radially therefrom, wherein the two or more side portions are flat in an initial unfolded configuration of the insert, wherein the two or more side portions are flexible and are thereby configured to form an at least partially curvilinear side wall having a similar shape as the curvilinear outer perimeter when folded.

11. The insert of claim 10, wherein the insert comprises a thermoformed or an injection molded plastic.

12. The insert of claim 10, wherein the insert comprises a transparent or translucent material.

13. The insert of claim 10, wherein the two or more side portions of the insert comprise an upper edge and a lower edge, wherein at least one of the two or more side portions of the insert further comprises a tab adjacent the upper edge of the at least one of the two or more side portions, wherein the lower edge of each side portion defines a straight line in the initial unfolded configuration of the insert, and wherein each side portion is attached to the curvilinear outer perimeter of the base of the insert at the lower edge of the respective side portion.

14. The insert of claim 10, wherein the side portions forming the side wall are separable from each other.

15. The insert of claim 10, wherein the insert comprises a flexible material.

16. The insert of claim 10, wherein the insert comprises a thickness, ranging from 0.001 inches to 0.05 inches.

17. The insert of claim 10, further comprising a perforated section, an indentation, a groove, or a combination thereof located along a connection point between the base of the insert and at least one of the two or more side portions of the insert.

18. A method of assembling a layered food item, the method comprising:

providing a food storage assembly comprising:

a container comprising a base and an opening defining a rim, wherein a side wall is circumferentially disposed between the base and the rim, the side wall of the container defining a curvilinear shape, and an insert having a base, wherein the insert comprises two or more side portions connected to the base and extending radially therefrom, wherein the two or more side portions are flat in an initial unfolded configuration of the insert, wherein the two or more side portions are flexible and form a side wall conforming to the curvilinear shape of the side wall of the container when the insert is positioned inside the container;

positioning the insert into the container, whereby the two or more side portions of the insert are flexed and folded to form the side wall of the insert conforming to the curvilinear shape of the sidewall of the container;

arranging a layer of a first food item within the insert; and arranging a layer of a second food item atop the layer of the first food item within the insert.

19. The method of claim 18, wherein the layer of the first or second food item is placed via an automated process.

20. The method of claim 18, wherein the first food item is a solid food item and wherein the second food item is a freezable, liquid food item.

* * * * *